US008716619B2

(12) United States Patent
Goossens et al.

(10) Patent No.: US 8,716,619 B2
(45) Date of Patent: May 6, 2014

(54) MEMS SWITCH

(75) Inventors: Martijn Goossens, Veldhoven (NL); Hilco Suy, Eindhoven (NL); Peter Gerard Steeneken, Valkenswaard (NL); Klaus Reimann, Eindhoven (NL)

(73) Assignee: NXP B.V., Eindhoven (NL)

( * ) Notice: Subject to any disclaimer, the term of this patent is extended or adjusted under 35 U.S.C. 154(b) by 186 days.

(21) Appl. No.: 13/306,675

(22) Filed: Nov. 29, 2011

(65) Prior Publication Data

US 2012/0305374 A1 Dec. 6, 2012

(30) Foreign Application Priority Data

Nov. 30, 2010 (EP) ..... 10193180

(51) Int. Cl.
*H01H 13/62* (2006.01)

(52) U.S. Cl.
USPC ..... 200/564; 200/181

(58) Field of Classification Search
USPC ..... 200/564
See application file for complete search history.

(56) References Cited

U.S. PATENT DOCUMENTS

| | | | | |
|---|---|---|---|---|
| 6,734,512 | B2 | 5/2004 | Suzuki | |
| 7,548,144 | B2 | 6/2009 | Kim et al. | |
| 7,859,370 | B2 * | 12/2010 | Shirakawa | 335/78 |
| 2006/0050360 | A1 | 3/2006 | Nelson et al. | |
| 2006/0181377 | A1 | 8/2006 | Kweon et al. | |

FOREIGN PATENT DOCUMENTS

| | | | |
|---|---|---|---|
| CN | 1193926 | C | 3/2005 |
| EP | 1 306 869 | A1 | 5/2003 |
| EP | 1 672 661 | A2 | 6/2006 |
| WO | 2009/147600 | A1 | 12/2009 |

OTHER PUBLICATIONS

"Membrane Switch", Wikipedia, 1 pg., retrieved from the internet at: Nov. 22, 2011, http://en.wikipedia.org/wiki/Membrane_switch (Oct. 31, 2011).
Extended European Search Report for Patent Appin. No. 10193180.6 (Apr. 28, 2011).

* cited by examiner

*Primary Examiner* — Renee Luebke
*Assistant Examiner* — Ahmed Saeed

(57) ABSTRACT

A MEMS switch in which at least first, second and third signal lines are provided over the substrate, which each terminate at a connection region. A lower actuation electrode arrangement is over the substrate. A movable contact electrode is suspended over the connection regions for making or breaking electrical contact between at least two of the three connection regions and an upper actuation electrode provided over the lower actuation electrode. The use of three of more signal lines enables a symmetrical actuation force to be achieved or enables multiple switch functions to be implemented by the single movable electrode, or both.

13 Claims, 9 Drawing Sheets

MEMS SWITCH

This invention relates to MEMS switches, particularly MEMS galvanic switches.

A MEMS galvanic switch comprises a first electrode arrangement that is present on a substrate and a movable element that overlies at least partially the first electrode arrangement. The movable element is movable towards the substrate between a first and a second position by application of an actuation voltage, providing electrostatic attraction.

In the first position, the movable element is separated from the substrate by a gap. The movable element comprises a second electrode that faces the first electrode arrangement. In the second position (closed switch) first and second electrodes are in mechanical and electrical contact with each other.

Known MEMS switches of this type can use electrostatic actuation in which electrostatic forces resulting from actuation drive voltages cause the switch to close. An alternative type uses piezoelectric actuation, in which drive signals cause deformation of a piezoelectric beam. This invention relates particularly to electrostatic switches.

Electrostatic galvanic MEMS switches are promising devices. They usually have 4 terminals: signal input, signal output, and two actuation terminals, one of which usually is kept at ground potential. By varying the voltage on the other actuation terminal, an electrostatic force is generated which pulls the movable structure downward. If this voltage is high enough, one or more contact dimple electrodes will touch and will provide a galvanic connection between the two signal terminals.

FIGS. 1 and 2 show one possible design of MEMS galvanic switch designed in accordance with known design principles.

In FIG. 1, the cross hatched pattern is the bottom electrode layer. This defines the signal in electrode 10, the signal out electrode 12 and lower actuation electrode pads 18*a*. As shown, the actuation electrode pads 18*a* are grounded.

A top electrode layer defines the movable contact element 16 as well as the second actuation electrode 18*b* to which a control signal ("DC act") is applied.

The second actuation electrode 18*b* has a large area overlapping the ground actuation pads 18*a* so that a large electrostatic force can be generated. However, because the top actuation electrode 18*b* and the movable contact element 16 are formed from the same layer, a space is provided around the movable contact element 16. Furthermore, overlap of the actuation electrodes and the signal lines is undesirable, as explained further below.

FIGS. 2A and 2B show two versions of the device in cross section taken through a vertical line in FIG. 1. The same components are given the same reference numbers. FIGS. 2A and 2B additionally show the substrate arrangement 2 and the gap 20 beneath the movable contact element 16. The actuation electrode 18 can be covered on one side with an electrically insulating layer as shown in FIG. 2A, or it can be covered on both sides with electrically insulating layers as shown in FIG. 2B, which shows an additional insulating layer 22.

The connection between the signal input and signal output electrodes is made by the movable contact electrode which has two contact dimples 21 as shown in FIG. 2. Galvanic MEMS switches can achieve low resistances Ron of less then 0.5 Ohm when they are switched on, and high isolation with small parasitic capacitance when they are off (Coff<50 fF). Typical dimensions are 50 to 200 μm outer diameter of the actuation electrode 18.

The device is manufactured in well known manner, in which sacrificial etching defines the gap 20.

Electrostatically actuated galvanic MEMS switches typically consist of a circular, suspended membrane that has a central portion that connects the two RF signal electrodes when it is deflected downwards. The device provides a single signal path and the actuation electrode is segmented in two equal parts positioned on opposing sides of the RF signal electrodes. This is shown in FIG. 1.

An alternative arrangement of the galvanic MEMS switch has been considered by the applicant, having an oval shape to replace the circular shape of FIG. 1. The main purpose of the oval shape is to mechanically strengthen the suspended membrane on the axis parallel to the RF electrode. During actuation, the membrane bends less across this axis than for a circular device. This gives the device a lower actuation voltage, a larger working range (voltage range between contact closure between 16 and 12 and pull-in of the switch's actuation electrode 18) and a larger maximum achievable contact force.

A disadvantage of this approach is that the RF electrodes need to be relatively long, which causes additional unwanted series resistance.

Another drawback of known designs is that many MEMS switches are required in order to implement more complicated switching functionality.

The invention is directed to these drawbacks of existing MEMS switch designs.

According to a first aspect of the invention, there is provided a MEMS switch, comprising:

a substrate;

at least first, second and third signal lines over the substrate, which each terminate at a connection region;

a lower actuation electrode arrangement over the substrate;

a movable contact electrode suspended over the connection regions for making or breaking electrical contact between at least two of the three connection regions; and an upper actuation electrode arrangement provided over the lower actuation electrode arrangement.

This design has more than two signal lines (and corresponding connection regions), but a single movable electrode for forming connections between the signal lines.

The signal lines can comprise radial connection lines, and the lower actuation electrode arrangement can comprise arcuate portions between the radial connection lines, which together have a circular outer shape, interrupted by the radial signal lines.

In this way, at least the lower actuation electrode arrangement is segmented into more than two parts. The actuation electrode parts can be spread evenly around the area of the suspended membrane, so that the deformation of the membrane during actuation is made more symmetric, but without requiring elongated signal lines or electrodes.

The presence of more than two RF signal electrodes also enables the device to perform additional functions. In particular, the actuation electrode segments can be actuated separately, thus giving the user the choice which electrodes are connected during actuation. The design can be designed for use as an n-pole m-throw switch.

In one example, the switch comprises four signal lines, which are connected at their connection regions as two pairs, wherein the switch is for making or breaking electrical contact between the two pairs of signal lines.

This defines a single pole single throw switch, but which has four signal lines to provide a symmetric actuation force.

In another example, the switch comprises four signal lines, wherein the movable electrode is tiltable in dependence on which actuation electrode portions are operated, and the switch is for making or breaking electrical contact between any selected pair of adjacent signal lines.

This provides a more versatile switch, in that there are four possible switch functions that can be implemented.

In another example, the switch comprises four signal lines, wherein the movable contact electrode comprises a first contact portion associated with one pair of adjacent signal lines and a second contact portion associated with the other pair of signal lines, wherein the movable electrode is tiltable in dependence on which actuation electrode portions are operated, and the switch is for selectively making or breaking electrical contact between one of the pairs of signal and/or the other of the pairs of signal lines.

This design can be used as a double pole single throw switch, even though there is only one controlled movable electrode.

In another example, the switch comprises three signal lines, wherein the movable electrode is tiltable in dependence on which actuation electrode portions are operated, and the switch is for selectively making or breaking electrical contact between one signal lines and one or other of the other two signal lines.

This design enables a single pole double throw switch to be formed.

In another set of examples, the lower actuation electrode arrangement comprises one independently drivable actuation electrode associated with each signal line, and wherein the movable electrode comprises a plate, wherein regions of the plate are individually drivable into contact with an associated connection region, such that any one signal line can be connected by the movable contact electrode to any other signal line.

This arrangement is even more versatile, in that large numbers of electrode lines (for example 6 or more) can be interconnected in a very adaptable way.

For example, the signal lines can be arranged so that the connection regions form as a closed shape, with the signal lines extending outwardly from the closed shape, and wherein a central part of the movable electrode plate comprises a fixed anchor region, such that the movable parts of the electrode plate comprise edge regions. The shape can comprises a rectangle or a regular polygon.

This design can be used generally for an n pole m throw switch, in that the signal lines can be configured in any arrangement, and the movable electrode can be segmented as desired.

These and other aspects of the device of the invention will be further explained with reference to the Figures, in which.

The invention provides a MEMS switch in which at least first, second and third signal lines are provided over the substrate, which each terminate at a connection region. In one embodiment, the signal lines comprise radial connection lines evenly angularly spaced, and a lower actuation electrode comprises arcuate portions between the radial connection lines, which together have a circular outer shape, interrupted by the radial signal lines. This provides a symmetrical actuation force and also enables various possible switch functions. In another embodiment. a movable contact electrode is suspended over the connection regions for making or breaking electrical contact between at least two of the connection regions, and the movable electrode comprises a plate, wherein regions of the plate are individually drivable into contact with an associated connection region, such that any one signal line can be connected by the movable contact electrode to any other signal line. This provides a versatile design.

The figures below show various MEMS switch layouts of the invention. All figures have been simplified so that only the relevant details are shown, in particular the signal line shapes, actuation electrode shapes and contact designs. The further implementation details are standard, for example as described further with reference to FIGS. 1 and 2.

Figure 1:
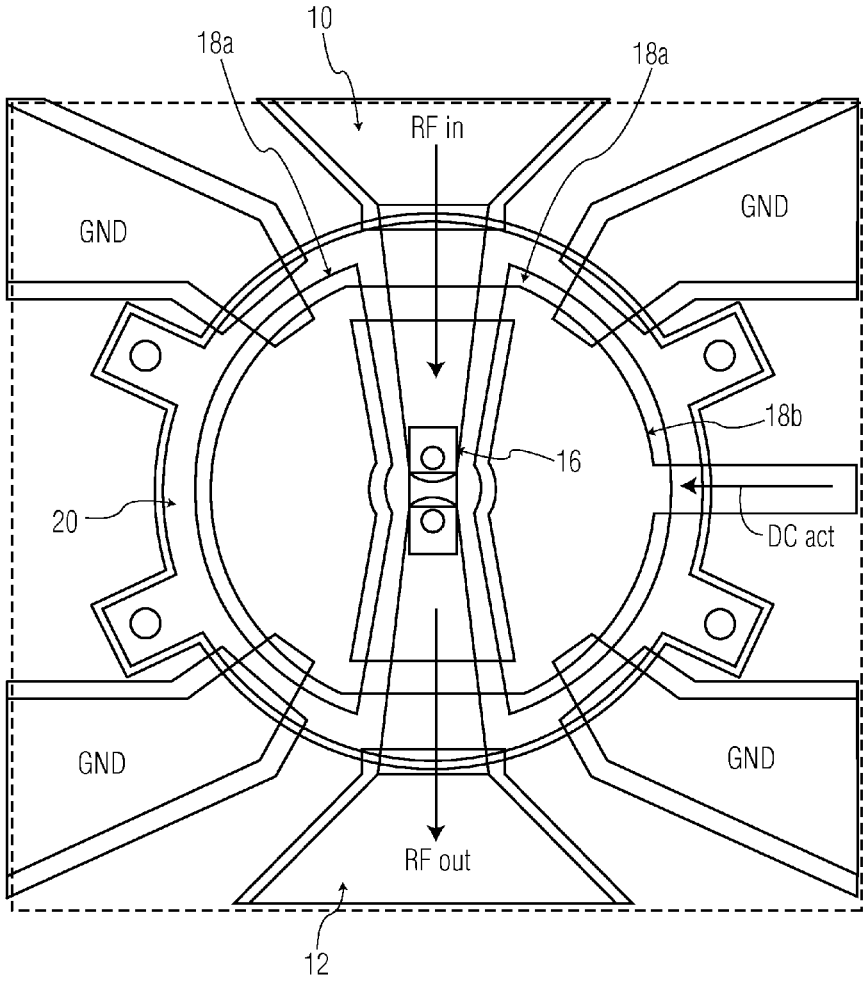
FIG. 1 shows a plan view of a known galvanic piezoelectric MEMS switch.
Figure 2A:
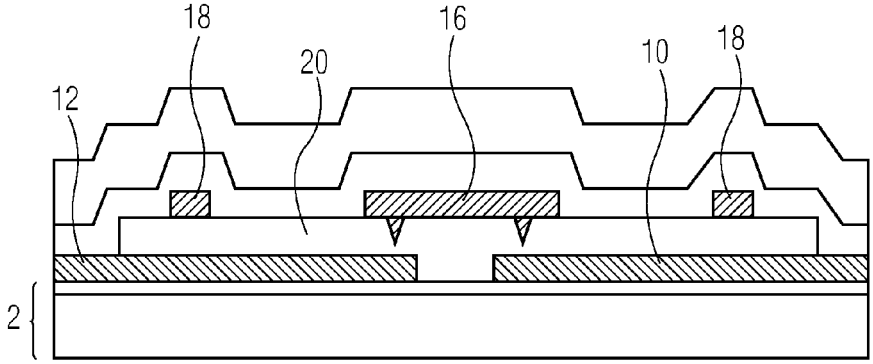
FIG. 2 shows the switch of FIG. 1 in cross section.
Figure 2B:
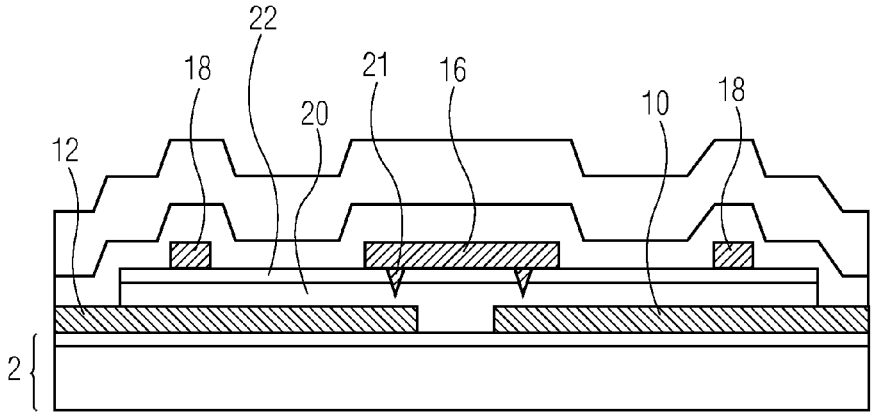
Figure 3:
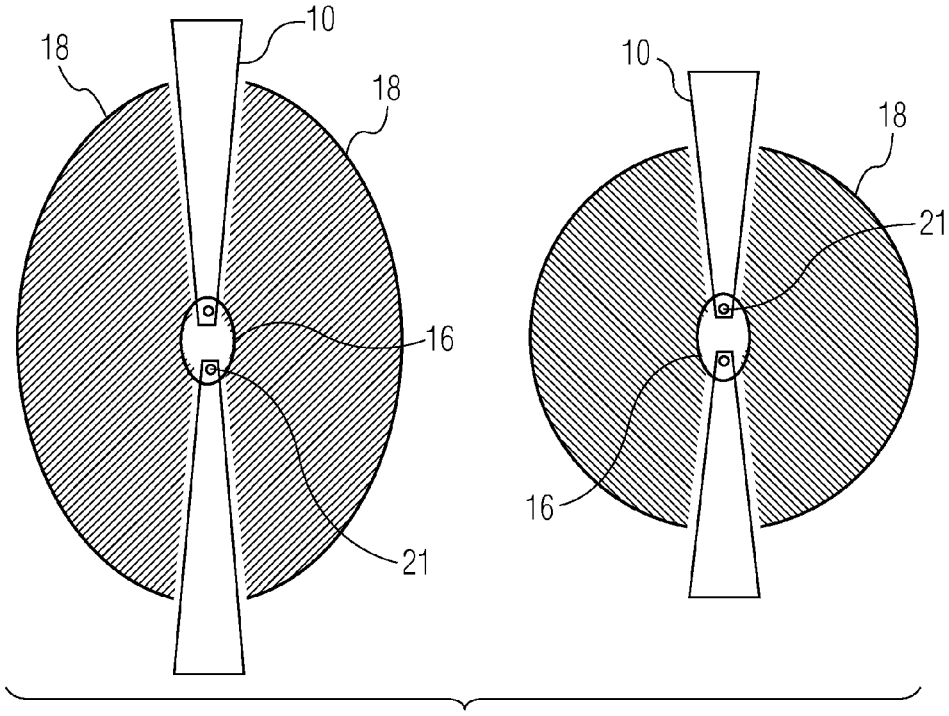
FIG. 3 PRIOR ART
FIG. 3 shows the configuration of the switch in schematic form, as well as a proposed modification to the layout.

In FIG. 3 and the following figures, the segmented arcuate hatched areas 18 represent the actuation electrodes. For simplicity, a single reference 18 is used to represent both actuation electrodes 18*a* and 18*b*. They are present in the lower layer that is fixed to the substrate (formed from the same layer as the signal lines 10, as can be seen in FIG. 1) and in the top layer that forms the suspended membrane. Thus, the regions 18 are intended to represent the shape of both the lower and upper actuation electrodes. The drawings are only schematic and the upper and lower electrodes do not have to be of the identical shape, although it is the overlap between them that provides the actuation force. The radial lines 10 represent the RF signal electrodes (and they may be the RF input or RF output lines); they are only present in the lower layer. The dots 21 in the central area represent the dimples that make contact to the RF electrodes, as most clearly seen in the cross section of FIG. 2. The dimples are electrically connected to each other by the central circular or oval regions 16 corresponding to the contact element 16 of FIG. 1. Both the dimples and circular/oval regions are present only on the suspended membrane.

By applying an electric potential difference between the actuation electrodes on the lower layer with respect to the actuation electrodes on the upper layer, the device is actuated. The suspended membrane deflects downwards and the dimples make contact to the RF signal electrodes. This closes the switch.

FIG. 3 shows the known MEMS switches. The right-hand device is a basic circular switch and the left hand device represents the modification having an oval shape mentioned above.

Figure 4:
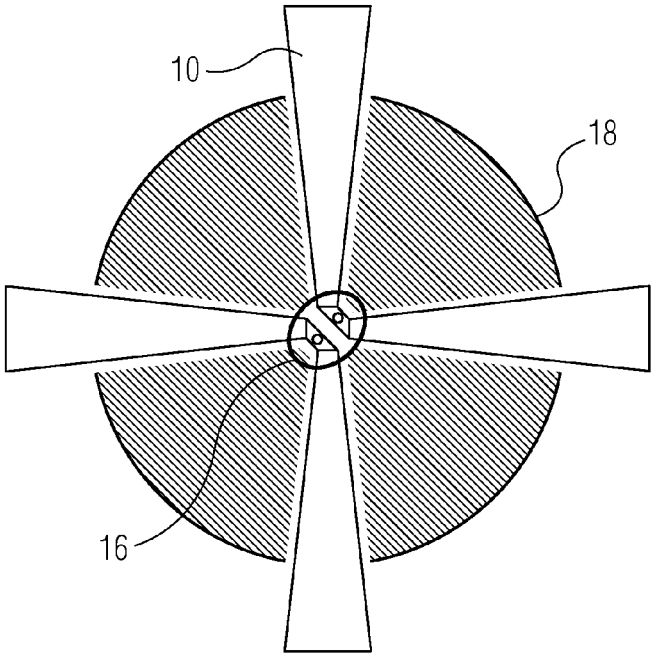
FIG. 4 shows an example of switch of the invention in schematic form.

FIG. 4 shows a first example of switch of the invention.

This version has two dimples 21, and is a single pole single throw switch. Although there are four signal lines, they are coupled in pairs, so that there is only one signal path across the switch (i.e. single pole). The design is single-throw, in that contact is either made or broken.

The signal lines comprise radial connection lines evenly angularly spaced. This means there are four actuation electrode portions, shaped as sectors of a circle and sandwiched between adjacent radial connection lines 10. The overall outer shape is circular.

When the device is actuated, one pair of signal lines is electrically connected to the other pair.

Figure 5:
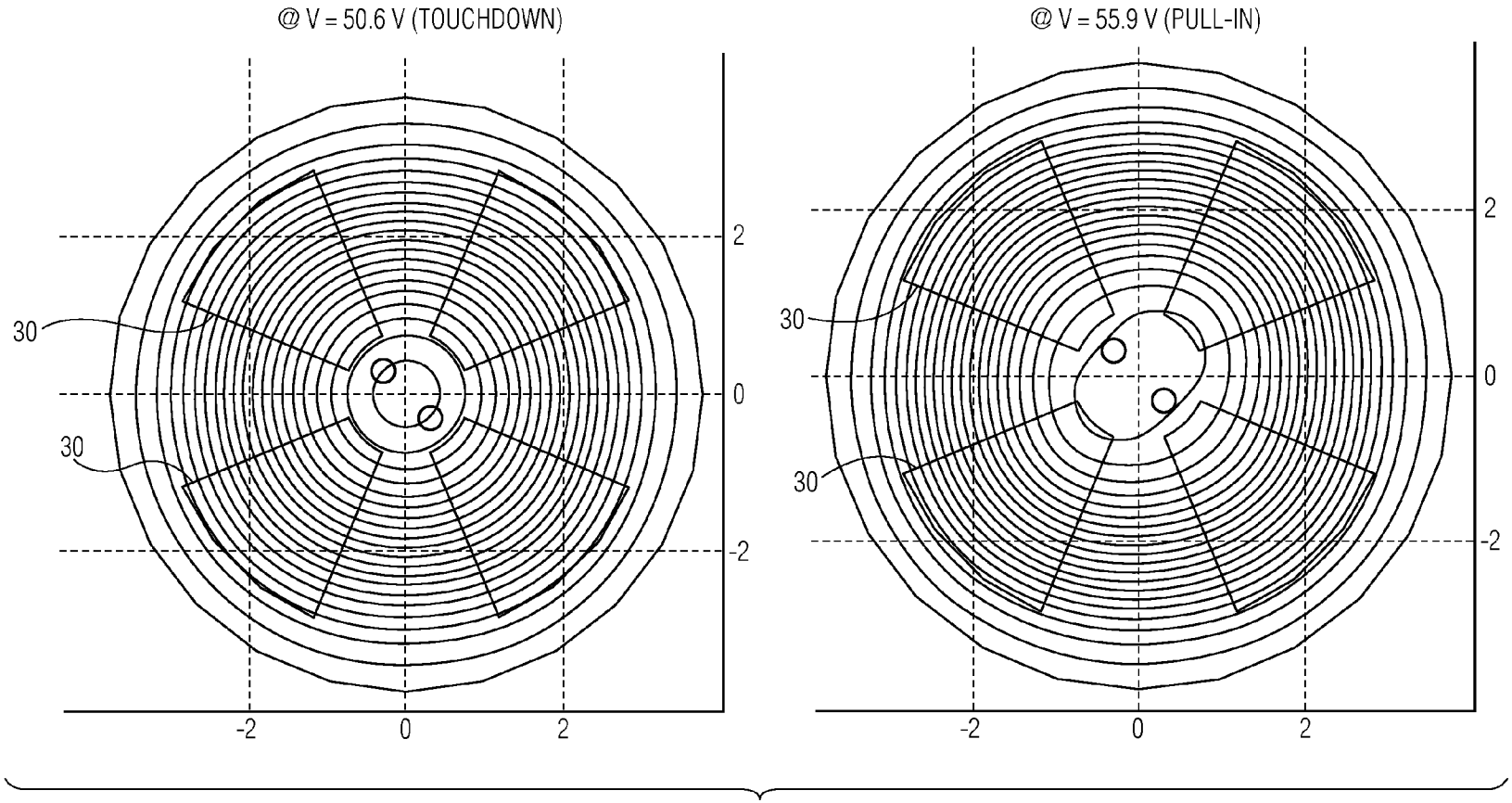
FIG. 5 is used to show the advantages of the design of FIG. 4.

FIG. 5 shows the results of a Finite Element simulation, which indicates that the deflection of the membrane (as represented by the concentric rings, which represent equal height areas) is nicely circular symmetric. In FIG. 5, the actuation electrodes 18 are shown but the RF electrodes are not shown. The dimples 21 are indicated with circles in the centre. At touchdown (i.e. when contact is initially made), the rings are circular as shown in the left image, while at pull-in (after further actuation beyond initial touchdown) they deform as shown in the right image.

This indicates bending of the membrane because of the presence of the dimples.

By way of example, the performance of a design in accordance with the invention has been compared with a corresponding conventional design, with only the electrode layout altered (i.e. comparing a design of FIG. 4 with the right image of FIG. 3, with the same layer thicknesses and materials and the same outer diameter of the circular actuation electrode).

In the results below, Vt is the voltage required for first contact, Vpi is the final pull in voltage, Range is the difference between Vpi and Vt (with Vt the voltage at which the contact is first made and Vpi the voltage at which the actuation electrodes collapse due to pull-in) and Fc,max is the maximum contact force.

The FIG. 3 design gave the following values:

Vt=59.2 V

Vpi=64.6 V

Range=5.4V

Fc,max=68 μN

The FIG. 4 design gave the following values

Vt=50.6 V

Vpi=58.5 V

Range=7.9V

Fc,max=93 μN

This simulation shows the advantages of the new design because the contact force has increased, the pull-in voltage has decreased and the range (Vpi-Vt) has increased. A small drawback is that the restoring force decreases by 15%. This is not detrimental for correct operation of the device because the restoring force has a much larger margin.

The arrangement of FIG. 4 functions in a similar way to a conventional switch, in that there are two possible settings—contact regions connected or not connected.

In preferred examples of the invention, the use of three or more signal lines with a shared movable electrode gives the switch greater versatility. In particular, the can have switch has three or more settings, for example (i) a first configuration of signal line connections, (ii) a different second configuration of signal line connections and (iii) no signal line connections.

The first two configurations can for example comprise the connection between a selected pair out of the three (or more) signal lines. This means that the first two configurations leave at least one signal line unconnected. To enable these multiple configurations, the single movable electrode needs to be able to close in different ways. In the examples below, the movable electrode is able to tilt as part of the closing function, so that different closure configurations can be defined.

Figure 6:
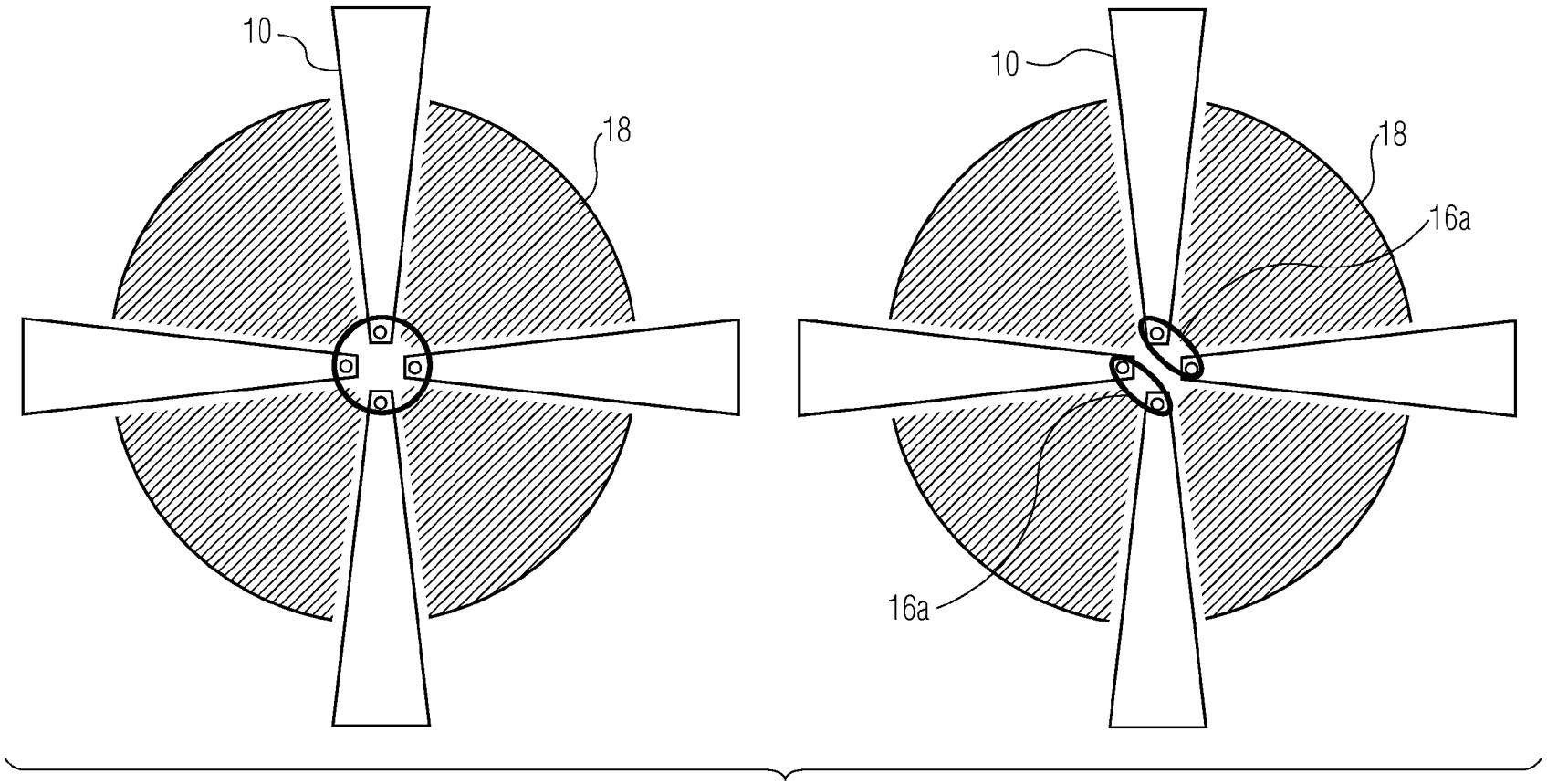
FIG. 6 shows two further examples of switch of the invention in schematic form.

FIG. 6 shows two further embodiments. The left image shows a switch that is designed to make contact between any pair of adjacent RF signal electrodes. For this purpose, the voltage on each actuation electrode 18 can be adjusted individually. The movable electrode will then tilt in the desired direction, towards the centre of the operated actuation electrode segment.

In this design, each signal line terminates at its own electrode. The electrodes are arranged in a ring. The movable electrode comprises a contact which has a contact area that covers the ring of electrodes. Depending how it is tilted, it can connect any adjacent pair of electrodes.

The right image shows a switch that can switch two balanced RF signals simultaneously or independently, depending on how the actuation electrodes are connected.

In this design, each signal line again terminates at its own electrode. The electrodes are arranged in a ring. The movable electrode comprises a contact which has two separate contact areas 16*a*, 16*b*. Each contact area can connect one associated pair of electrodes together or not. Depending how the two contact areas are tilted, they can connect one pair of electrodes or connect the other pair electrodes, or connect both pairs of electrodes. This effectively functions as two independent single pole single throw switches, thus forming a double pole single throw switch.

Figure 7:
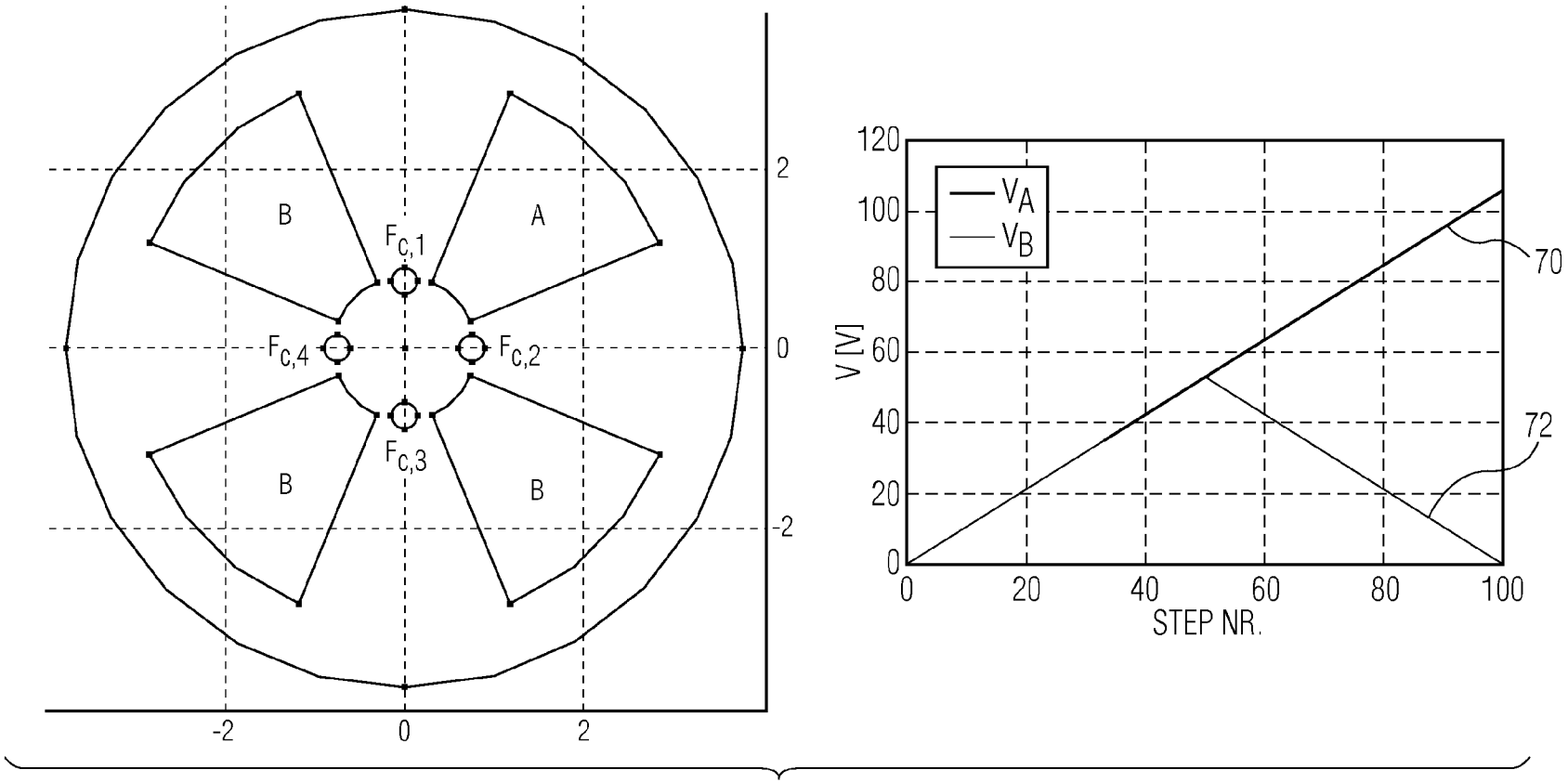
FIGS. 7 and 8 are used to show the operation characteristics of one of the designs of FIG. 6.

FIG. 7 shows simulation results for the design of FIG. 6. It shows one electrode (A) driven with one voltage $V_A$ and the other three (B) driven with another voltage $V_B$.

With a well-chosen sequence of voltages on the four quadrants of the switch it is possible to land any set of adjacent dimples.

In the graph of FIG. 7, plot 70 is the voltage $V_A$ applied to the single electrode A and plot 72 is the voltage $V_B$ applied to the set of three electrodes B. The contact dimples are numbered C1 through C4 with corresponding forces FC1 through FC4.

The graph on the right shows that in the simulation the voltage on all electrodes is ramped up to 50 volts, enough for touch down of all four dimples. Thereafter, the voltage on actuation electrode A is further increased, while the voltage on electrodes B is reduced.

Figure 8:
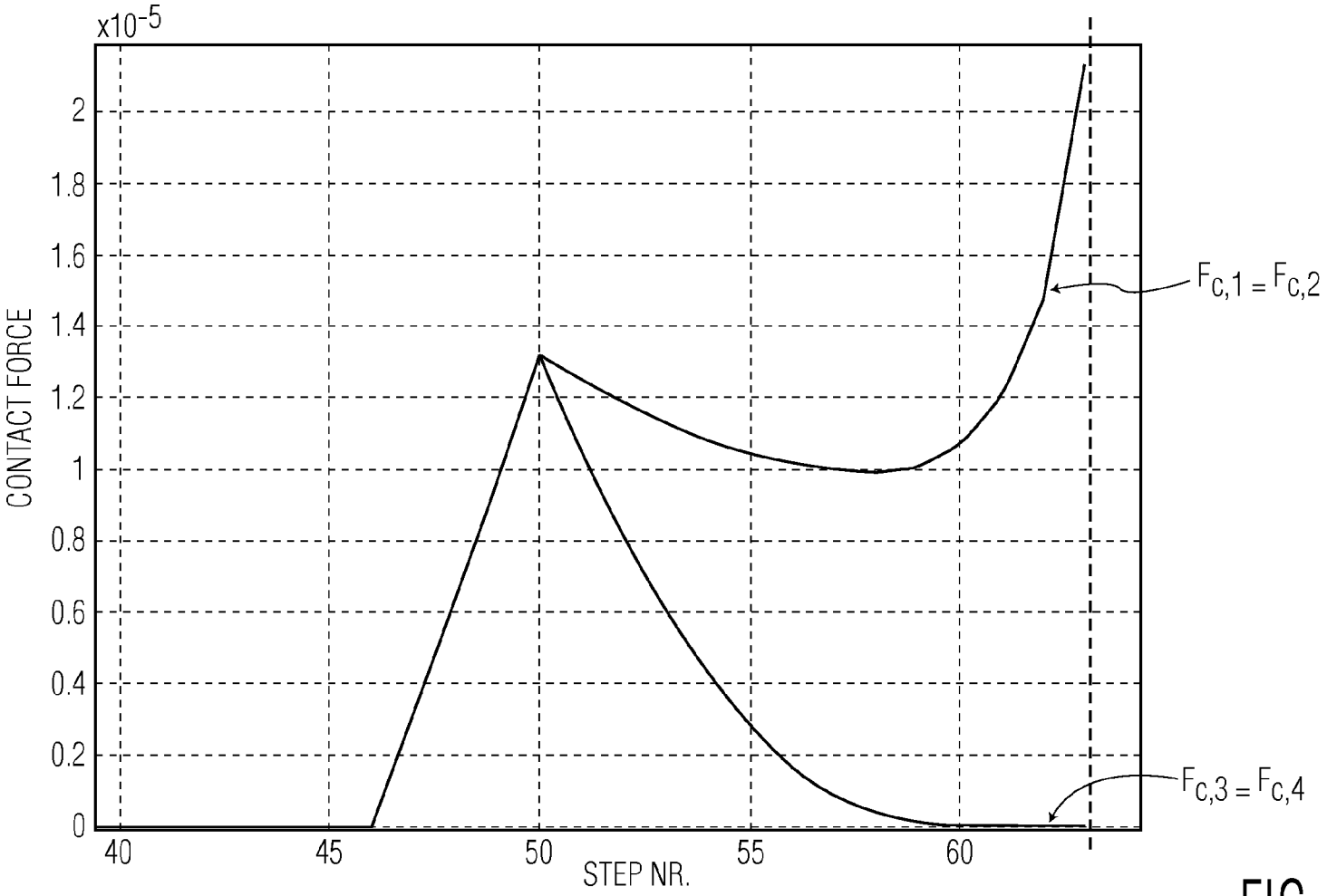

FIG. 8 shows a graph of the resulting contact force on all four dimples.

It is possible to have a high contact force on dimples C1 and C2, and an (almost) zero contact force on dimples C3 and C4.

The performance can be optimised based on size and shape of the individual components of the device and the sequence of signals applied to the actuation electrodes.

Many more variations are possible.

Figure 9:
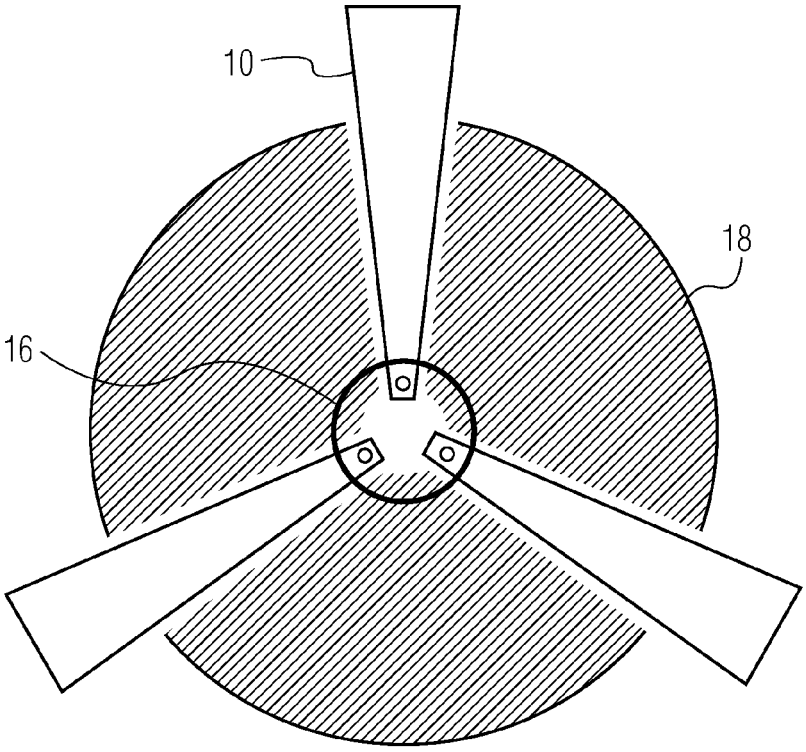
FIG. 9 shows a further example of switch of the invention in schematic form.

For example, FIG. 9 shows a single pole double throw switch.

In this design, there are three signal lines 10. Each signal line terminates at its own electrode. The electrodes are arranged in a ring. The movable electrode comprises a contact which has a contact area that covers the ring of electrodes. Depending how it is tilted, it can connect any adjacent pair of electrodes. Thus, one input electrode can be connected to either of the other two signal lines as output, giving single pole double throw functionality.

The examples above provide a signal line and actuation electrode design for a single switch. The invention also provides designs which provide multiple switch elements in a combined compact design, in particular sharing the movable electrode. Thus, the same concept of a shared movable electrode for three or more signal lines is applied, but the signal lines are not distributed among a set of lower actuation electrodes; instead each signal line has its own lower actuation electrode, for example a circular actuation electrode which is interrupted only by the single associated signal line. Each such signal line and actuation electrode can be though of as a switch element, and the movable electrode is shared between the switch elements.

Thus, each switch element has an independently drivable actuation electrode 18 and a single associated signal line 10.

The shared movable contact electrode (again suspended over the connection regions of the signal lines) comprises a plate. Regions of the plate are individually drivable into contact with an associated connection region, such that any one signal line can be connected by the movable contact electrode to any other signal line.

Figure 10:
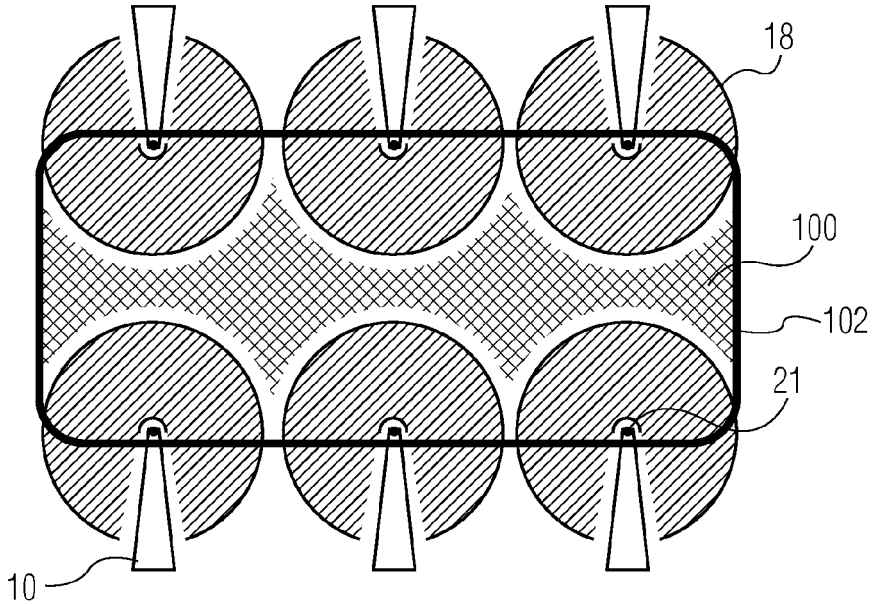
FIG. 10 shows a further example of switch of the invention in schematic form.

FIG. 10 shows a first example, and which can be used to implement a multiple pole-multiple throw switch.

In this figure, in area 100 both top metal and bottom metal are present, so that there is no suspended membrane. This defines an electrode region. The two metal layers are permanently connected to each other in this area. This defines a central anchor region, and the peripheral regions are the movable parts The device has six RF electrode lines 10, each with its own suspended membrane and corresponding actuation electrode 18. The six dimples 21 are all connected to each other through the top metal and through the low-ohmic lower metal by virtue of the central area.

When a voltage is applied to any set of two actuation electrodes, a connection is made between the corresponding RF signal electrodes. Essentially, the movable electrode 102 can be deformed so that different portions can be brought into contact with the associated signal line.

Figure 11:
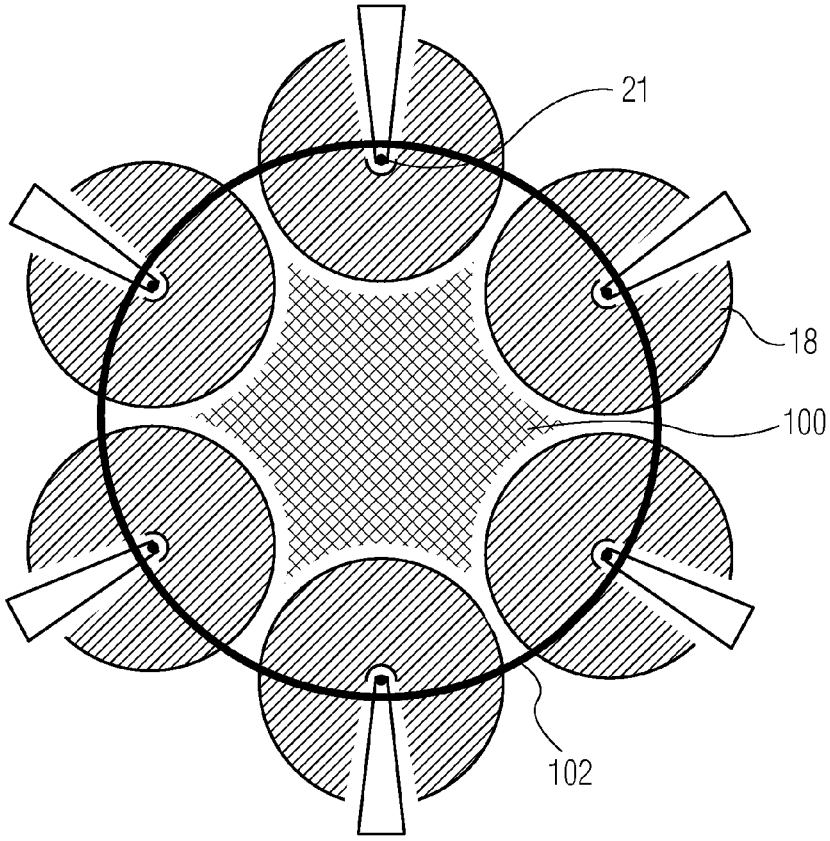
FIG. 11 shows a further example of switch of the invention in schematic form.

This variation is not limited to 6 electrodes, and not to its rectangular shape either. A hexagonal alternative is shown in FIG. 11.

Figure 12:
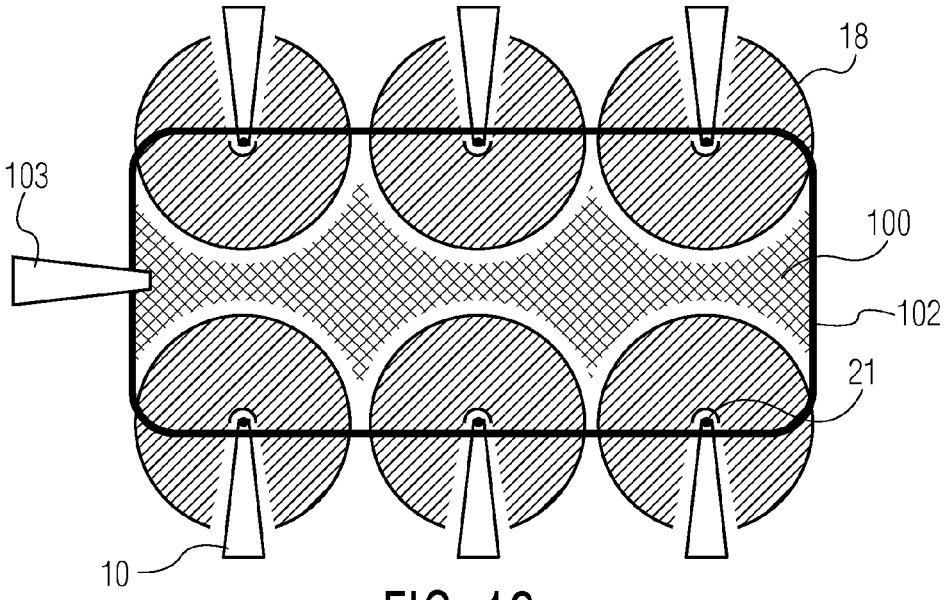
FIG. 12 shows a further example of switch of the invention in schematic form.

In FIG. 12 an alternative implementation is shown where an additional signal line 103 is directly electrically connected to electrode region 100, creating a single pole, six throw design. This implementation has the advantage that the electrical signal only has to go through a single contact area 21 instead of through two contact areas 21 when going from electrode 103 to any of the output electrodes lines 10 (as opposed to travelling between two signal lines 10). The resistance and losses are therefore lower. This implementation can also be used in FIGS. 3, 4, 6, 9, 10, 11 by connecting the additional signal line 103 to the movable contact region 16.

These designs enable multiple pole designs (in that different signal lines can be part of different circuits) and/or multiple throw designs (in that one signal line can be connected to a choice of other signal lines).

If all contact dimples are connected, the different circuits for a multiple throw switch cannot be operated independently. However a general n-pole m-throw switch can be created by segmenting the movable electrode into different electrically separated regions, with one region for each pole of the switch, and a number of signal lines associated with each region giving rise to the desired number of throws. A general n-pole m-throw switch can also be created by combining several of the proposed switch devices.

The manufacturing steps to fabricate the switch designs above are routine to those skilled in the art, and differ from the known techniques only in the patterning selected. One difference in terms of processing between the device described and the devices of FIG. 3 is that it can be beneficial to include one more isolating dielectric layer. This layer enables the crossing of the two metal layers without making contact between them, and can also prevent direct contact between the actuation electrodes 18 and the signal electrodes 10. This is helpful to electrically connect individual electrodes on chip. This extra layer is not essential, however it can simplify switch design and interconnect layout and it can increase reliability because direct contact between electrodes 18 and 12 in FIG. 2 is prevented. This is the layer 22 in FIG. 2. The switch arrangement could be placed upside down on top of the substrate, such that the movable parts become fixed and some of the fixed parts become movable.

The application is of particular interest for galvanic switches (analogue switches, RF switches, high power switches, high-bandwidth digital switches).

Various other modifications will be apparent to those skilled in the art.

The invention claimed is:

1. A MEMS switch, comprising:

a substrate;

at least first, second and third signal lines over the substrate, which each terminate at a connection region;

a lower actuation electrode arrangement over the substrate;

a movable contact electrode suspended over the connection regions for making or breaking electrical contact between at least two of the three connection regions; and an upper actuation electrode arrangement provided over the lower actuation electrode, and wherein the signal lines comprise radial connection lines, and wherein the lower actuation electrode arrangement comprises arcuate portions between the radial connection lines, which together have a circular outer shape, separated by the radial signal lines.

2. A switch as claimed in claim 1, comprising six signal lines, each terminating at the center of a respective circular connection region, wherein the respective circular connection regions are arranged in a circle.

3. A switch as claimed in claim 1, wherein the radial connection lines are evenly angularly spaced.

4. A switch as claimed in claim 1, comprising four signal lines, which are connected at their connection regions as two pairs, wherein the switch is for making or breaking electrical contact between the two pairs of signal lines.

5. A switch as claimed in claim 1, comprising four signal lines, wherein the movable contact electrode is tiltable in dependence on which actuation electrode portions are operated, and the switch is for making or breaking electrical contact between any selected pair of adjacent signal lines.

6. A switch as claimed in claim 1, comprising four signal lines, wherein the movable contact electrode comprises a first contact portion associated with one pair of adjacent signal lines and a second contact portion associated with the other pair of signal lines, wherein the movable contact electrode is tiltable in dependence on which actuation electrode portions are operated, and the switch is for selectively making or breaking electrical contact between one of the pairs of signal and/or the other of the pairs of signal lines.

7. A switch as claimed in claim 1, comprising three signal lines, wherein the movable electrode is tiltable in dependence on which actuation electrode portions are operated, and the switch is for selectively making or breaking electrical contact between one signal line and one or other of the other two signal lines.

8. A MEMS switch as claimed in claim 1, wherein:

the lower actuation electrode arrangement comprises one independently drivable actuation electrode associated with each signal line, and wherein the movable contact electrode comprises a plate, wherein regions of the plate are individually drivable into contact with an associated connection region, such that any one signal line can be connected by the movable contact electrode to any other signal line.

9. A switch as claimed in claim 8, wherein the signal lines are arranged so that the connection regions form as a closed shape, with the signal lines extending outwardly from the closed shape, and wherein a central part of the movable electrode plate comprises a fixed anchor region, such that the movable parts of the electrode plate comprise edge regions.

10. A switch as claimed in claim 9, wherein the shape comprises a rectangle or a regular polygon.

11. A switch as claimed in claim 8, comprising at least 6 signal lines.

12. A switch as claimed in claim 1, wherein the upper actuation electrode and the movable contact electrode are formed from the same layer.

13. A switch as claimed in claim 1, wherein the lower actuation electrode and the signal lines are formed from the same layer.

* * * * *